United States Patent [19]

Falomo

[11] 4,265,431

[45] May 5, 1981

[54] APPARATUS FOR WASHING DEVELOPED PHOTOGRAPHIC AND LIKE FILMS

[76] Inventor: Lodovico Falomo, Via Codroipo 5, Orcenigo Inferiore, Zoppola (Pordenone), Italy

[21] Appl. No.: 38,852

[22] Filed: May 14, 1979

[30] Foreign Application Priority Data

May 19, 1978 [IT] Italy ..... 23608 A/78

[51] Int. Cl.[3] ..... C22B 11/02

[52] U.S. Cl. ..... 266/101; 75/118 R; 75/118 P; 266/111; 266/112

[58] Field of Search ..... 266/101, 111, 112; 75/118 P, 118 R

[56] References Cited

U.S. PATENT DOCUMENTS 3,705,716 12/1972 Hendrickson ..... 75/118 P X 4,150,977 4/1979 Phillips ..... 75/118 P

FOREIGN PATENT DOCUMENTS 1353805 5/1974 United Kingdom ..... 75/118 P

*Primary Examiner*—G. T. Ozaki

*Attorney, Agent, or Firm*—Cushman, Darby & Cushman

[57] ABSTRACT

For recovering silver and discharging depolluted wastes from washing baths for photographic and like films or papers, a method is disclosed which consists in having the washing liquid running in countercurrent relationship in a number of serially arranged tubs, relative to the direction of advance of the photographic material being washed.

The concentration of silver salts is thus increased in a direction contrary to that of advance of the sensitive materials being processed so that the first tub of the series (considered in the machine direction) has such a concentration of silver that the recovery by any methods is economically interesting.

5 Claims, 1 Drawing Figure

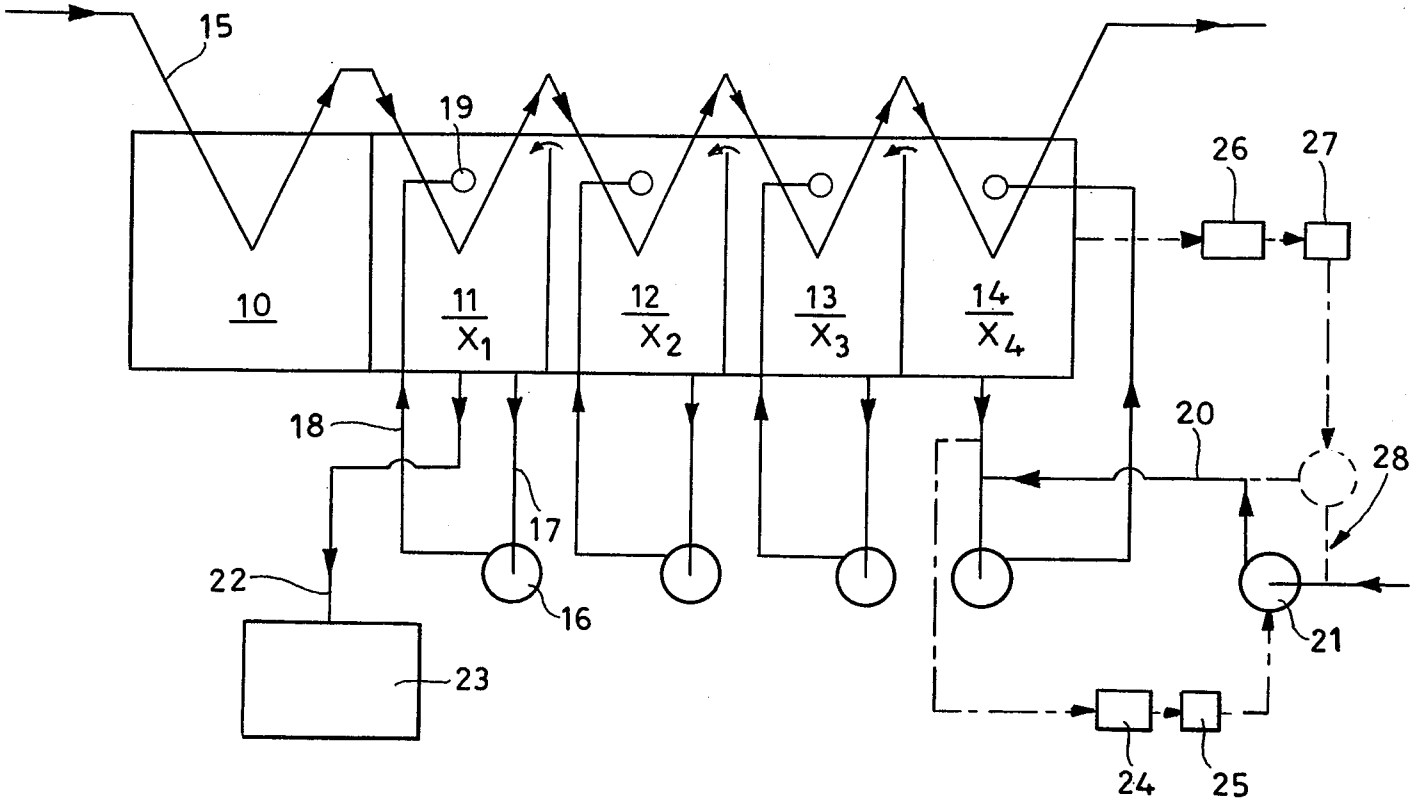
10
11
X1
12
X2
13
X3
14
X4
15
16
17
18
19
20
21
22
23
24
25
26
27
28

APPARATUS FOR WASHING DEVELOPED PHOTOGRAPHIC AND LIKE FILMS

This invention relates to a method and an apparatus which permit the washing of movie films, photographic negatives and prints on positive and invertible paper, and afford manifold and considerable advantages as compared with the systems conventional heretofore.

It is known that the final stage of the developing run is washing with water, properly heated, the sensitive material in order to remove those chemicals such as silver, sodium and ammonium thiosulphate, the presence of which would cause a progressive yellow discoloration of the material during the shelf life.

In the developing macninery known heretofore, washing takes place, as a rule, in water filled tubs, the water being heated at an appropriate temperature, wherein the sensitive material stays for a preselected period of time.

The necessity of carrying out a careful washing of the sensitive material imposes the requirement of having baths available which have a very low concentration of salts; this circumstance is such as to lead to a high water use and high power use for heating, so that the processing runs become very expensive.

Moreover, the high mass of water in use originates considerable problems whenever it is desired to effect any depolluting process on such water prior to dumping same. Nobody has considered heretofore economically wise to recover silver from the washing waters of sensitive material, on account of the high dilutions otherwise imposed by the currently adopted washing procedures.

An object of the present invention is thus to do away with the shortcomings enumerated above by dispensing with technical expedients which have been considered heretofore as essentials, and, more detailedly, with a view to limiting drastically or minimizing the volume of water required for washing sensitive materials.

Another object of the present invention is to make it possible to separate silver from the washing waters in a manner which is economically acceptable while concurrently permitting, by virtue of such a recovery, to obtain waste waters the polluting power of which is definitely below the pollution level downstream of the conventional washing machinery.

The foregoing and other objects, which will more clearly appear from the ensuing description, are achieved by carrying out a washing run characterized in that the washing is performed by having the material being passed in succession through a plurality of tubs fed in counterflow relationship with a rate of flow of liquid introduced in the last tub in an amount which is sufficient to maintain the concentration below a preselected value, and in that liquid is discharged from the first of the tubs in which the sensitive material is introduced, and is subjected to silver-recovery operations.

Such a process is carried out with advantage by utilizing an apparatus which is characterized in that it comprises a plurality of washing tubs, a device for conveying the sensitive material in succession through each of said tubs, overflow passageways for the washing liquid between each tub and its next, means for feeding liquid to the last tub and a discharge for the liquid from the first of the tubs over which the conveying mechanism runs, an apparatus for the separation of silver, fed by said discharged liquid.

In order that the advantages and the essential features of the invention may become clearer, an exemplary embodiment of same will be given hereinafter and illustrated in the accompanying drawing.

BRIEF DESCRIPTION OF THE DRAWINGS

In the diagrammatical showing of the single FIGURE of the drawing, a cross-sectional view is shown of an automatic developing machine, with special reference to those component parts which differ from the conventional ones in order to carry the principles of this invention into constructive practice.

DETAILED DESCRIPTION

There are shown at 10, 11, 12, 13 and 14 five sequentially arranged tubs through which the conveying web of the sensitive material to be processed is caused to flow. On considering the conventional character of the assembly and actuation means of such a kind of web, the FIGURE shows only its path in a diagrammatical fashion, indicated at 15.

Let now the tub 10 be considered as a conventional bleaching and fixing tub for the sensitive materials.

The tubs 11-14 make up the washing area, and each of them is equipped with a recycling pump 16, which draws liquid from the tank bottom with a suction pipe 17 to send it to a delivery pipe 18 which opens at a mouth 19 placed at a comparatively high level in the tub.

The action of the recycling pump keeps, as far as practicable, uniform the concentration of the solutes in the liquor, preventing localized concentration increases and encouraging a whirling motion which makes the washing of the material conveyed by the web quicker.

In addition, provisions are made for feeding washing water 20, in the loop of which a pump 21 is inserted, and which normally opens at the intake side of the pump 16 of the tub 14.

The excess of water caused by the feed in the tub 14 overflows into the tub 13 and so forth to the tub 11, the latter having a sump 22 to the reservoir 23.

In addition, a device 24 is provided which is responsive to the concentration of liquid drawn from the tub 14, and which is active upon the control 25 of the pump 21 in the sense that it actuates the pump when the concentration of salts exceeds a preselected value, and stops it when the concentration drops below another preselected value.

Provision can be made, with advantage, for an additional sensor 26 which drives a control 27 of the feeding circuit 28 in parallel with the pump 21. The sensor 26 is still responsive to the concentration of salts in the liquid of the tub 14, and is intended to obviate, as an emergency control, to the failure of the sensor 24 or the apparatus driven thereby.

The principle of operation of the sensors 24 and 26 can be based either on a conductivity-metering or a colorimetric measurement, with or without the introduction of an appropriate labeling element in the solution for bleaching and fixing contained in the tub 10, or it can be based also on a measurement of specific gravity.

The term conductivity-metering defines any measurement of conductivity of the solution carried out at a high or a low frequency, with or without electrodes in contact with the medium.

The term colorimetric measurement defines any measurement of absorbance irrespective of the wavelength or any particular kind of instrument employed for measuring it.

Among the methods indicated above, the conductivity-metering approach is especially suitable.

No detailed description is given of the components of the circuitries which drive the feed of water as a function of the concentration, since these are well known to those skilled in the art.

The operability of the machine clearly appears from its very structure: the washing water is passed by overflowing from the tub 14 to the tub 13 and so forth through the sequentially arranged tubs to the reservoir.

These sequential passes establish ever and ever increasing concentrations of silver salts when proceeding from the tub 14 to the tub 11, so as to obtain in the end tub 11 a concentration which is high enough as to permit an advantageous recovery of the metal.

Such a system for metal recovery can be specially provided in connection with the reservoir 23 but is not described herein since it is conventional. There can be used, to this purpose, a conventional electroless silver-recovery system, or an electrolytic system if the concentrations are sufficiently high, that is with a considerably high number of washing tubs, or a chemical system such as precipitation systems, or physico-chemical systems such as separation systems based on ionic exchange, inverted osmosis and others.

In order to afford a more detailed evaluation of the surprisingly advantageous results obtained by the invention, a processing run according to the invention is described hereinafter by way of example only.

Assuming a washing system composed by four stages (tubs) for treating color paper of the resin coated type, the indicative data of the system are as follows:

| | |
|---|---|
| Processed paper | 300 $m^2$ an hour |
| Solution conveyed by the paper | 50 $cm^3/m^2$ |
| Concentration of the solution conveyed by the paper (total salt content): | |
| [$Y_0$] at the inlet of the washing system | 200 grams per liter |
| [$Y_4$] at the outlet of the washing system | 1.2 grams per liter |
| concentration of the solution in the washing tubs (total salt content): | |
| X 0 water entering tub 14 | 0 grams per liter |
| X 4 water entering tub 14 | 0.84 grams per liter |
| X 3 water entering tub 13 | 1.48 grams per liter |
| X 2 water entering tub 12 | 5.40 grams per liter |
| X 1 water entering tub 11 | 29.00 grams per liter |

The concentrations have been calculated by means of the balance equations:

$$P+W=1$$

$$P_{Y_{n-1}}+W_{X_{n+1}}=P_{Y_n}+W_{X_N}$$

and with the equilibrium equation:

$$Y_n=KX_n, \text{ wherein } K=1.2$$

washing efficiency: $\eta=0.6$ concentration of silver in the stages: in the bleaching and fixing bath (tub 10) 3 grams/liter

| | |
|---|---|
| in the washing stage N° 1 | 0.44 grams/liter |
| in the washing stage N° 4 | 0.012 grams/liter |

With these assumptions, the usage of washing water as compared with the magnitudes which are normally accepted is reduced as follows:

| | |
|---|---|
| usage with the conventional systems | 1300 liters an hour |
| usage with counterflow washing, 4-stage, according to this invention | 110 liters an hour |

The following tabulation reports the variations of the total salt concentration and of silver in the last stage (tub 11 in the example shown in the drawing) as a function of the number of stages of the system.

| | Number of stages | | | | |
|---|---|---|---|---|---|
| | 1 | 2 | 3 | 4 | 5 |
| Total concentration; grams/liter | 0.5 | 7.3 | 18.3 | 29.0 | 39.7 |
| Silver concentration g/l | 0.0075 | 0.11 | 0.27 | 0.43 | 0.6 |

As regards more particularly the procedure for recovering silver from water of stage N° 1 starting from a two-stage system it is possible to adopt an electroless or chemical precipitation of physico-chemical procedure, whereas, with a system composed by four or five stages, the electrolytic recovery procedure can be adopted with advantage.

I claim:

1. Apparatus for treating a material with washing liquid to remove a soluble constituent from the material by washing, said apparatus comprising: a plurality of washing tubs including a first tub, a last tub and at least one intermediate tub; means for conveying the material through all of said tubs in sequence beginning with the first tub; overflow passages for the washing liquid between each tub and the next; means for feeding fresh washing liquid to the last tub; means for discharging washing liquid from the first tub; and control means responsive to the concentration of solutes in the last tub for controlling said feeding means in a mode to feed liquid when the concentration exceeds a preselected value whereby the volume of washing liquid is minimized.

2. Apparatus as in claim 1 including means for recycling and stirring the liquid in each tub.

3. Apparatus as in claim 1 including means for recovering a desired dissolved constituent from the liquid discharged from the first tub by said discharge means.

4. Apparatus as in claim 3 wherein said recovery means is a silver-recovery means.

5. Apparatus for washing sheet material made sensitive to light by an emulsion containing silver salts, after the sheet material has been developed and fixed, said apparatus comprising: a plurality of washing tubs including a first tub; a last tub and at least one intermediate tub; means for conveying the sheet material through all of the tubs in sequence beginning with the first tub; means for feeding fresh washing liquid to the last tub; overflow means between each tub and the next for passing washing liquid countercurrent to the direction of travel of the sheet material through the tubs and for maintaining a generally fixed level of washing liquid in those tubs upstream from the first tub; means for discharging washing liquid; and control means responsive to the concentration of solutes in the last tub controlling said feeding means in a mode to feed washing liquid when the concentration exceeds a preselected value thereby minimizing the volume of washing liquid which is required.

* * * * *